US011404771B2

(12) United States Patent
Gorman et al.

(10) Patent No.: US 11,404,771 B2
(45) Date of Patent: Aug. 2, 2022

(54) SINGULAR PROCESS PRINTED ANTENNA WITH FEED NETWORK AND SYSTEMS AND METHODS RELATED TO SAME

(71) Applicant: L3 Technologies, Inc., New York, NY (US)

(72) Inventors: Joel B. Gorman, Allen, TX (US); Brian Clark, Plano, TX (US)

(73) Assignee: L3 Technologies, Inc., New York, NY (US)

( * ) Notice: Subject to any disclaimer, the term of this patent is extended or adjusted under 35 U.S.C. 154(b) by 99 days.

(21) Appl. No.: 16/721,330

(22) Filed: Dec. 19, 2019

(65) Prior Publication Data

US 2021/0194116 A1 Jun. 24, 2021

(51) Int. Cl.

| | |
|---|---|
| ***H01Q 1/38*** | (2006.01) |
| ***H01Q 1/24*** | (2006.01) |
| ***H01Q 1/42*** | (2006.01) |
| ***H01Q 1/36*** | (2006.01) |

(52) U.S. Cl.

CPC ..... *H01Q 1/38* (2013.01); *H01Q 1/24* (2013.01); *H01Q 1/36* (2013.01); *H01Q 1/42* (2013.01)

(58) Field of Classification Search

CPC .. H01Q 1/24; H01Q 1/38; H01Q 1/42; H01Q 1/36

USPC ..... 343/872

See application file for complete search history.

(56) References Cited

U.S. PATENT DOCUMENTS

| | | | | |
|---|---|---|---|---|
| 4,697,192 | A * | 9/1987 | Hofer | H01Q 11/083 343/708 |
| 5,353,040 | A * | 10/1994 | Yamada | H01Q 11/08 343/895 |
| 5,479,180 | A * | 12/1995 | Lenzing | H01Q 11/083 343/729 |
| 2019/0372212 | A1 * | 12/2019 | Kirknes | H01Q 1/50 |

OTHER PUBLICATIONS

Micropen Medical, "Printing Functional Traces On Medical Devices", Printed From Internet Mar. 11, 2019, 4 pgs.
Micropen Medical, "Applications", Printed From Internet Nov. 14, 2019, 4 pgs.
Ohmcraft, "CN Series Custom Leaded Resistor Networks", Printed From Internet Nov. 21, 2019, 2 pgs.
Micropen Medical, "Inks", Printed From Internet Nov. 14, 2019, 3 pgs.
Micropen Medical, "Library Product Photos", Printed From Internet Nov. 14, 2019, 3 pgs.
Micropen Medical, 2019, Obtained Nov. 21, 2019, 1 pg.

(Continued)

*Primary Examiner* — Hai V Tran

(74) *Attorney, Agent, or Firm* — Egan, Enders & Huston LLP.

(57) ABSTRACT

Antennas, systems and methods may be implemented using a feed network with optional balanced to unbalanced conductor (balun) structure printed on one or more varying surfaces (e.g., sides, faces, etc.) of antenna substrates of various shapes including, but not limited to, flat, cylindrical, hemispherical and conical-shaped antenna substrates. Both antenna element/s and feed network/s may be printed onto one or more varying surfaces of a single common antenna substrate, such as printed onto both interior and exterior surfaces of the same hollow antenna substrate.

26 Claims, 10 Drawing Sheets

(56) References Cited

OTHER PUBLICATIONS

Micropen Medical,"Micropenning",Printed From Internet Nov. 14, 2019, 3 pgs.
Micropen Medical, "Substrates", Printed From Nov. 14, 2019, 3 pgs.

* cited by examiner

SECTION A-A

SECTION B-B

SINGULAR PROCESS PRINTED ANTENNA WITH FEED NETWORK AND SYSTEMS AND METHODS RELATED TO SAME

FIELD

This invention relates generally to antennas and, more particularly, to antenna elements and feed networks for same.

BACKGROUND

In a conventional front fed antenna, the transition from coaxial cable to antenna element is typically complicated. Conventional antenna feed line creation techniques are limited, and may employ a circuit card assembly (CCA) having an etched balanced to unbalanced balun matching network, or may utilize a direct feed coaxial cable without a balun feed network. Front fed antenna solutions that utilize a feed network on a circuit card assembly with etched balun feed network typically have structurally loaded solder joints. Other front fed antenna solutions utilize a direct fed coaxial connection without a balun matching network, which means that the performance of the antenna is adversely affected.

In a traditional front fed hollow antenna structure, a balun feed network is typically formed on a separate circuit card assembly (CCA) or printed circuit board that is positioned as a separate piece inside the hollow antenna structure, with the balun feed network electrically connected by a solder joint to an antenna element of the separate antenna. Besides requiring physical space, feed boards create extra parts, connectors, and points of failure. Solder joints pose the highest failure risk over thermal and vibrational requirements. With each additional part a joint is added, creating a vulnerability to thermal expansion, vibrational stresses, and tolerance issues that can cause losses and failures. For smaller-size conventional front fed antennas, the amount of interior space available within the hollow antenna structure to contain a balun feed network board is very small, reducing or altogether eliminating the solution pool of acceptable balun feed network configurations.

Consequently, many conventional front fed antennas employ inefficient packaging and exhibit a high risk of failure, together with high cost, due to the required multiple separate electronic component parts and the solder joints that accompany them. Other conventional front fed antennas lack a balun matching network, the lack of which degrades antenna performance.

SUMMARY

Disclosed herein are antennas, systems and methods that may be implemented with one or more feed network/s (printed on one or more surfaces (e.g., sides, faces, etc.) of an antenna substrate and, in one embodiment, one or more of the feed network/s may be a balanced to unbalanced (balun) feed network that includes a balun structure. In one embodiment, a feed network of an antenna may be printed together (e.g., printed at the same time) with one or more antenna elements on one or more surfaces of a common antenna substrate in a simpler manner than conventional antenna fabrication technology that requires assembly of multiple separate parts, and in a manner that reduces antenna cost and failure risk by minimizing and/or eliminating such separate parts and soldered joints. In a further embodiment, both antenna element/s and feed network/s may be printed onto one or more varying surfaces (e.g., faces or sides) of a single common antenna substrate, e.g., including printed onto both interior and exterior surfaces of the same hollow antenna substrate. The disclosed antennas, systems and methods may be implemented using antenna substrates of various shapes including, but not limited to, flat, cylindrical, hemispherical and conical-shaped antenna substrates. Applications for the disclosed antennas include, but are not limited to, aircraft antennas (e.g., such as nose radar antennas), spacecraft or rocket antennas, cellular antennas (e.g., for mobile phones, tablet devices, notebook computers, etc.), cellular towers, as well as other applications described further herein.

In one exemplary embodiment, the disclosed antennas, systems and methods may be implemented with antenna designs employing multiple antenna arms with multiple antenna elements, e.g., such as antennas radiating multiple field polarities having multiple signal feeds. In some embodiments, an antenna having printed feed network/s (optionally including a balun feed network) may be provided that does not include a separate board or circuit card for the feed network/s. Instead, an antenna (e.g., front-fed antenna or other type of antenna) may be implemented having one or more feed network/s that are printed on an inner surface of a hollow antenna structure substrate (e.g., such as a hollow conical or hollow cylindrical antenna structure), thus simplifying the interface between antenna element/s and a cable or other type signal feed for the antenna. The configuration of such an embodiment eliminates the presence of a solder joint transition from each feed network to the antenna element, which poses the highest structural risk in conventional antenna designs due to coefficient of thermal expansion (CTE) mismatch and loads carried through the conventional joint. Thus, using the disclosed embodiments, cost of parts and risk of failure may be reduced, and antenna reliability increased, relative to conventional antenna designs.

In one embodiment, printed feed network (feed line) and antenna element patterns may be fabricated on multiple sides of the same antenna substrate so as to reduce part count, antenna cost, and failure risk. In another embodiment, a balun configuration may also be incorporated as part of a printed feed network along with any desired matching network and/or filters. In another embodiment, improved antenna performance may be realized (compared to conventional coaxial direct feed configurations) by providing balun feed network configurations (e.g., tapered, stepped, etc.) which would not otherwise be present in a conventional design. In a further embodiment, printed pads for passive and active components may be added to an antenna substrate during the antenna fabrication process. In one embodiment, the disclosed antennas, systems and methods may be implemented in the fabrication and implementation of complex antenna geometries as a single part that would be difficult to fabricate as separate parts, e.g., including antenna configurations such as log periodic dipole arrays and reflector antennas.

In the practice of the disclosed antennas, systems and methods, conductive areas (e.g., conductive traces that form antenna element/s, feed network and/or feed network with optional balun circuitry, etc.) may be printed together on a dielectric or electrically-insulating antenna substrate material using any suitable conductive printing technique/s. Examples of antenna element pattern types include, but are not limited to, helical, spiral, and sinuous-shaped antenna element patterns. In one exemplary embodiment, print fabrication techniques may be employed that are similar to those used in the manufacture of medical catheters, i.e., by applying ink to an antenna substrate with an applicator such as a proboscis. In such an embodiment, use of an applicator allows the feed network/s and antenna element/s to be printed on the respective inside and outside surfaces of an antenna substrate, and allows feed network/s to be fabricated on relatively small substrate inner surface diameters (e.g., such as less than or equal to 0.25 inches). Further, fabrication of feed networks for more complex antenna configurations (e.g., such as a dual polarity 4-arm, 2-feed conical sinuous antenna) is much simpler using the disclosed methods than would be the case using more complex conventional feed circuit boards or circuit cards.

As disclosed herein, a conductive metal ink (e.g., gold or silver ink) may be used to create the conductive areas (e.g., conductive traces) that form an antenna element/s and circuitry on one or more surfaces of an antenna substrate. The conductive metal ink may include a conductive metal powder mixed with a polymer binder. It will be understood that other types of conductive inks (both metal and non-metal conductive inks) may be employed that include other types of binders, other types of metal and/or non-metal conductive particles or other conductive constituents.

In one respect, disclosed herein is an antenna, including: an antenna substrate having opposing first and second ends with at least one internal opening defined to extend through the antenna substrate from the first end to the second end of the antenna substrate; at least one feed network printed as an electrically conductive pattern on an interior surface of the internal opening, the feed network extending from the first end to the second end of the antenna substrate; and at least one antenna element printed as an electrically conductive pattern on an exterior surface of the antenna substrate, the antenna element being electrically coupled to the feed network.

In another respect, disclosed herein is a method, including: printing at least one feed network as an electrically conductive pattern on an interior surface of at least one internal opening defined to extend through an antenna substrate from a first end of the antenna substrate to an opposing second end of the antenna substrate, the feed network extending from the first end to the second end of the antenna substrate; printing at least one antenna element as an electrically conductive pattern on an exterior surface of the antenna substrate; and electrically coupling the antenna element to the feed network.

In another respect, disclosed herein is a system, including an assembly that includes: an antenna; and a radome mechanically coupled to at least partially surround the antenna. The antenna may include: an antenna substrate having opposing first and second ends with at least one internal opening defined to extend through the antenna substrate from the first end to the second end of the antenna substrate, and at least one feed network printed as an electrically conductive pattern on an interior surface of the internal opening with the feed network extending from the first end to the second end of the antenna substrate; and at least one antenna element printed as an electrically conductive pattern on an exterior surface of the antenna substrate, the antenna element being electrically coupled to the feed network.

DESCRIPTION OF ILLUSTRATIVE EMBODIMENTS

FIGS. 1-2 and 3A-3B illustrate respective frontal perspective, side cross-sectional, rear partial cross-sectional and rear exploded views of an assembly 100 that includes a conical radome 104 and baseplate 110 that are assembled around a conical antenna substrate 102. A conical-shaped radome such as illustrated in FIGS. 1-2 and 3A-3B may be utilized, for example, for antenna applications where aerodynamic performance and minimum air stream drag is desirable, e.g., such as for elevated signal transmission tower applications, aircraft nose antenna applications, rocket or spacecraft nose antenna applications, etc. However, different radome shapes are also possible to fit characteristics of other applications, e.g., such as hemispherical, flat, various other form factors, etc. In one embodiment, radome 104 may be any material that protects and/or at least partially covers the underlying antenna substrate 102, and that is transparent or non-attenuating to incoming and/or outgoing electro-magnetic (EM) radiation, e.g., such as radio frequency (RF) and other EM signals. Examples of suitable radome materials include, but are not limited to, low dielectric materials such as polyurethane foam, polyether ether ketone, liquid crystal polymer, polyimide quartz, Ultem® or other polyetherimide, etc.

Figure 1:
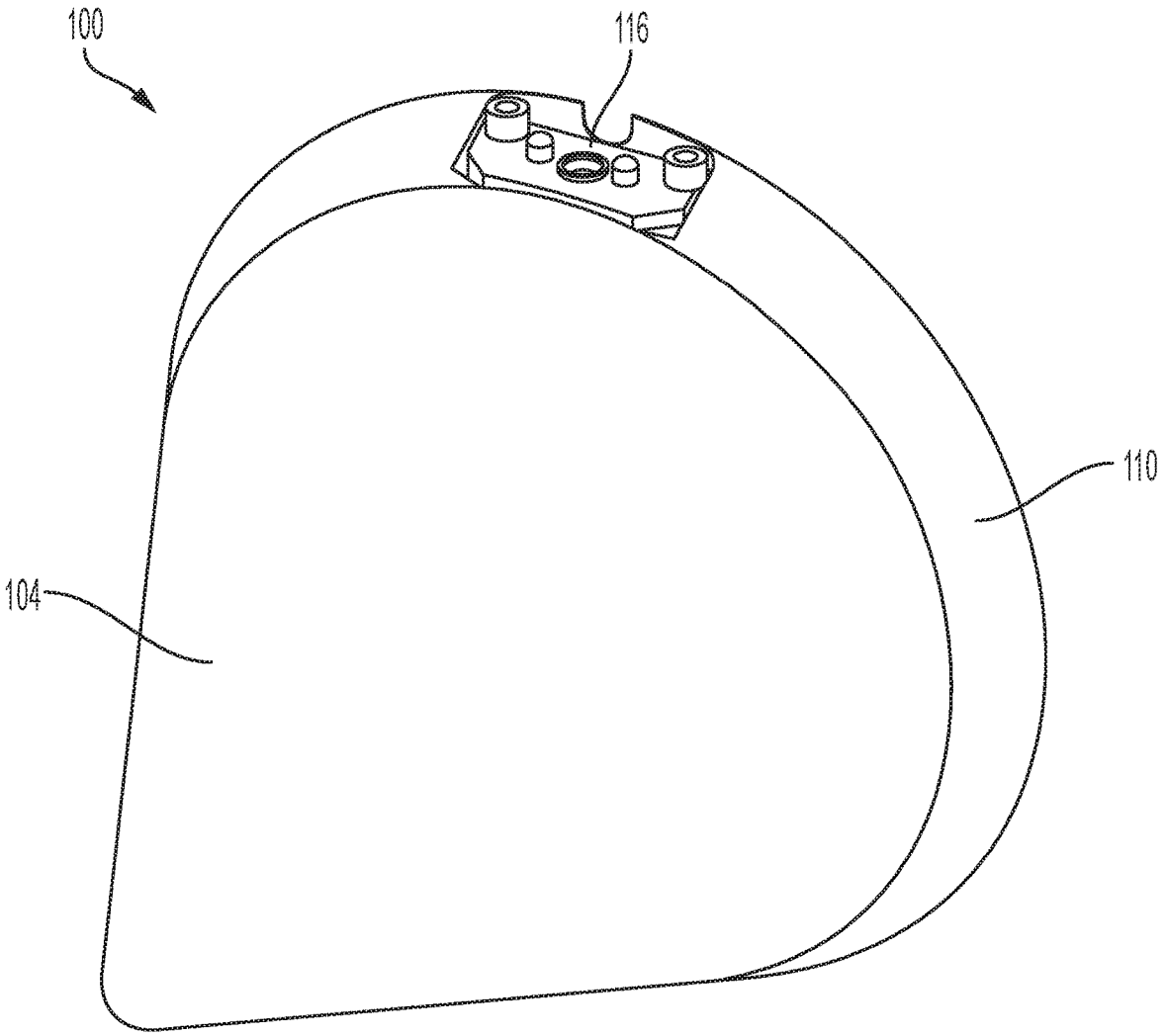
FIG. 1 illustrates a frontal perspective view of an assembly according to one exemplary embodiment of the disclosed antennas, systems and methods.
Figure 2:
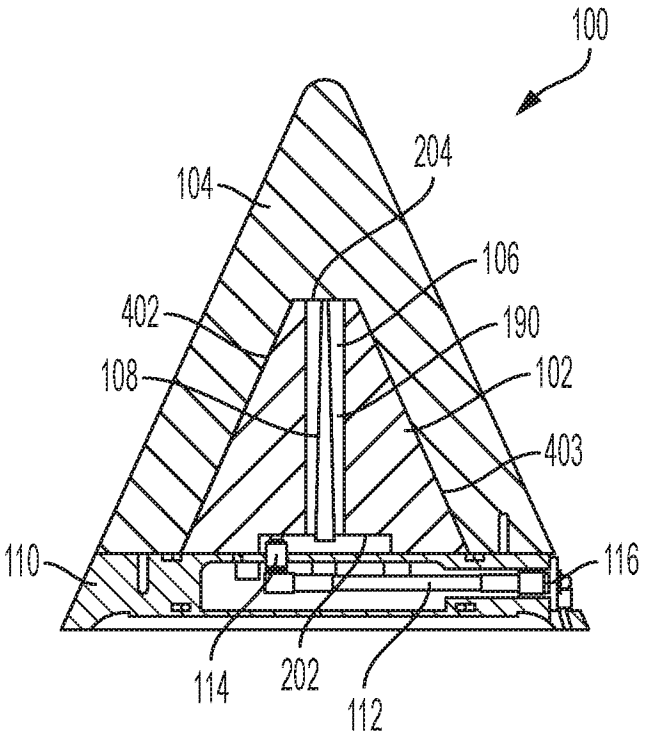
FIG. 2 illustrates a side cross-sectional view of an assembly according to one exemplary embodiment of the disclosed antennas, systems and methods.
Figure 3A:
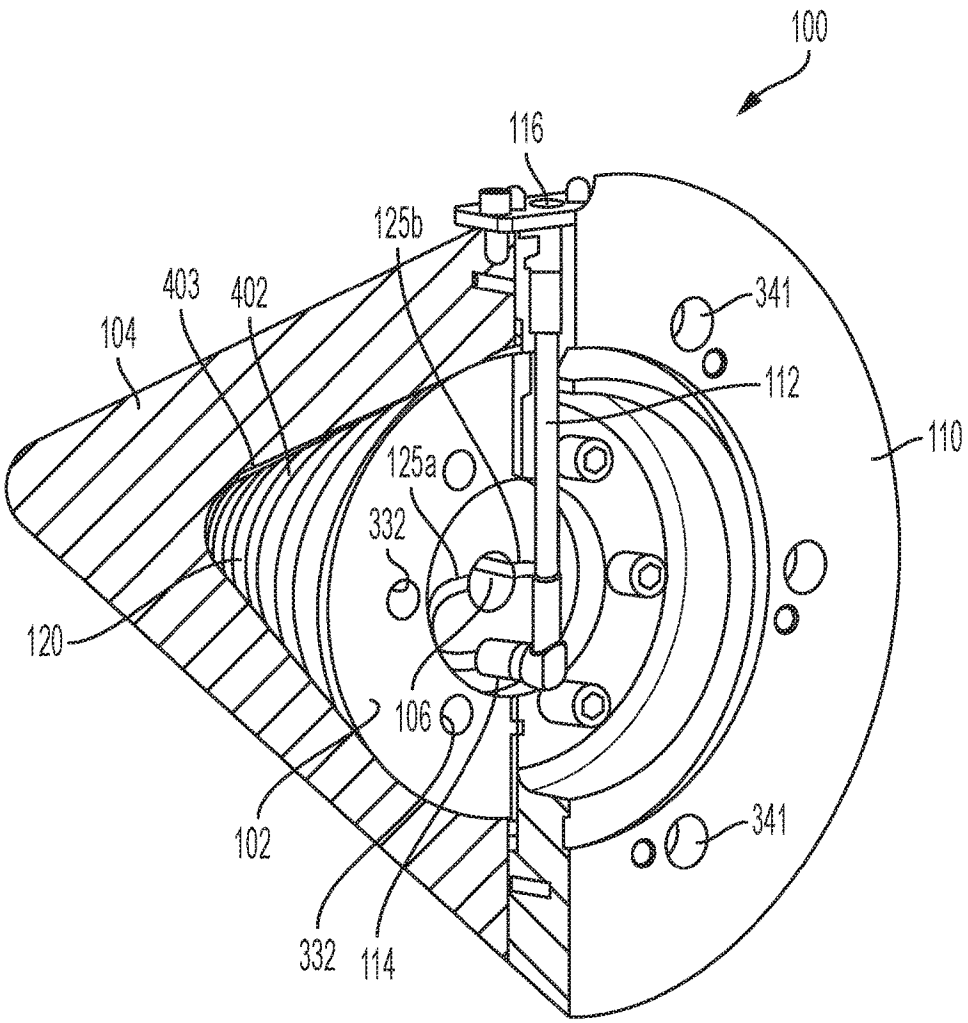
FIG. 3A illustrates a rear partial cross-sectional view of an assembly according to one exemplary embodiment of the disclosed antennas, systems and methods.
Figure 3B:
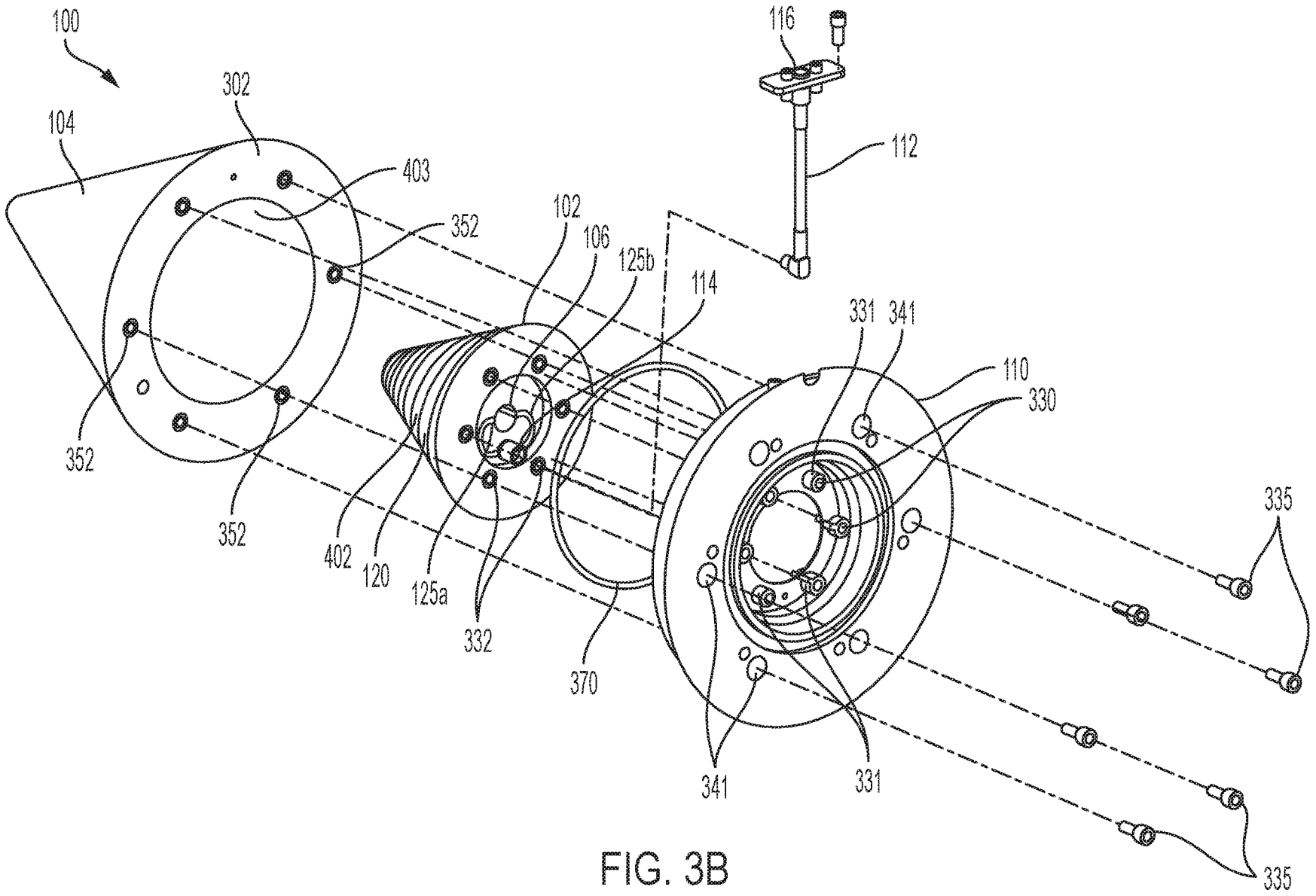
FIG. 3B illustrates a rear exploded view of an assembly according to one exemplary embodiment of the disclosed antennas, systems and methods.

Referring to FIGS. 2 and 3A-3B, a baseplate 110 (e.g., metal plate such as aluminum, steel, etc.) may be optionally present as shown to provide both an electrical ground as well as a strengthened support base for supporting coaxial cable feed line/s 112, coaxial connector/s 114 and 116, and antenna substrate 102 together in secure assembled mechanical relationship with radome 104, as well as to provide a structure for mounting assembly 100 to other components and structures, e.g., such as for mounting to an elevated transmission tower, an aircraft or rocket fuselage, etc. Mounting fasteners 330 (e.g., threaded bolts) may be received through mounting openings 331 defined within baseplate 110 into aligned threaded openings 332 defined within rear end 202 of antenna substrate 102 as shown in order to secure baseplate 110 to antenna substrate 102. Additional mounting openings 341 may be defined in baseplate 110 to receive mounting fasteners 335 that may be similarly received within threaded openings 352 defined in the rear surface 302 of radome 104 in order to secure radome 104 to baseplate 110 with antenna substrate 102 positioned therebetween. A gasket (e.g., rubber, etc.) may be optionally present as shown to seal any space between baseplate 110 and surface of antenna substrate rear end 202. It will be understood the assembly of radome 104 to antenna substrate 1021 through baseplate 110 is exemplary only, and that other configurations may be employed to maintain a radome in operational relationship with an antenna substrate (e.g., with and without the use of a baseplate).

As shown in FIGS. 2 and 3A-3B, antenna substrate 102 of this embodiment has a conical-shaped front outer surface 402 that is complementary in size and shape to a size and shape of a mating inverse conical-shaped inner surface 403 of radome 104 so as to allow radome 104 to fit closely (e.g., in mechanical contact) around antenna substrate 102 as shown. However, it will be understood that in some embodiments a radome and antenna substrate may alternatively be assembled together with a space defined between the inner surface of a radome and the outer surface of the antenna substrate. It will also be understood that a radome may be dimensioned to at least partially or completely cover, surround or overlay any selected portion of an outer surface of an antenna substrate, e.g., depending on the characteristics of a given application. In yet other embodiments, it is possible that an antenna substrate may be provided and operated in an uncovered state, i.e., without the presence of a radome.

In the practice of the disclosed antennas, systems and methods, an antenna substrate may be of any shape that is suitable for supporting one or more antenna elements capable of receiving and/or transmitting EM radiation, e.g., in the form of RF signals or other EM signals. Some examples of other antenna substrate shapes are illustrated in FIGS. 5-9 herein, it being understood that additional antenna substrate shapes are also possible. In the disclosed antennas, systems and methods, an antenna substrate 102 may be composed of any one or more material/s depending on desired dielectric and environmental requirements, e.g., such as plastic (e.g., polyetheretherketone "PEEK", liquid crystal polymer, etc.), ceramics (e.g., alumina, etc.), etc.

As shown in FIGS. 2 and 3A-3B, at least one elongated cylindrical internal opening 106 may be defined as shown to extend through a center of the conical body of antenna substrate 102 from a rear end 202 to a front end 204 of antenna substrate 102 to provide an interior path for an antenna feed network between antenna rear end 202 and antenna front end 204. In this embodiment, internal opening 106 is cylindrical in shape and has a circular cross-section, with a center of internal opening 106 coinciding with (i.e., centered upon) the center of the conical body of antenna substrate 102. In one embodiment, a diameter of an internal opening 106 of a conical antenna substrate 102 may be driven by the smallest diameter portion of the conical body of antenna substrate 102 (i.e., the tip of the spiral), with smaller conical antenna diameters corresponding to higher frequency operation.

Figure 4A:
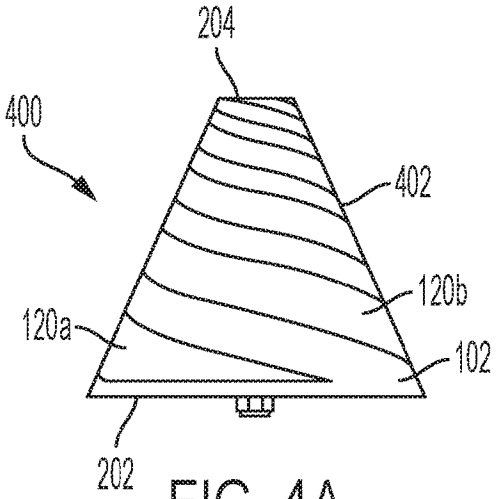
FIG. 4A illustrates a side view of an antenna according to one exemplary embodiment of the disclosed antennas, systems and methods.
Figure 4C:
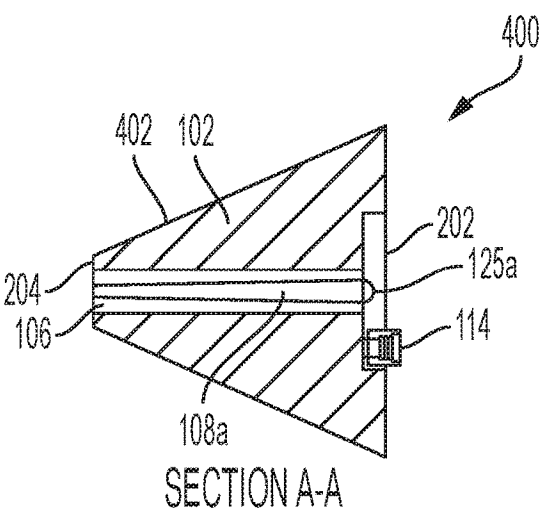
FIG. 4C illustrates a side cross-sectional view of an antenna according to one exemplary embodiment of the disclosed antennas, systems and methods.
Figure 4D:
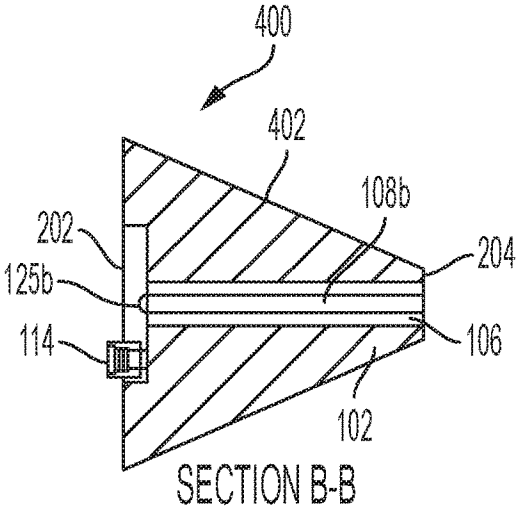
FIG. 4D illustrates another side view of an antenna according to one exemplary embodiment of the disclosed antennas, systems and methods.
Figure 4B:
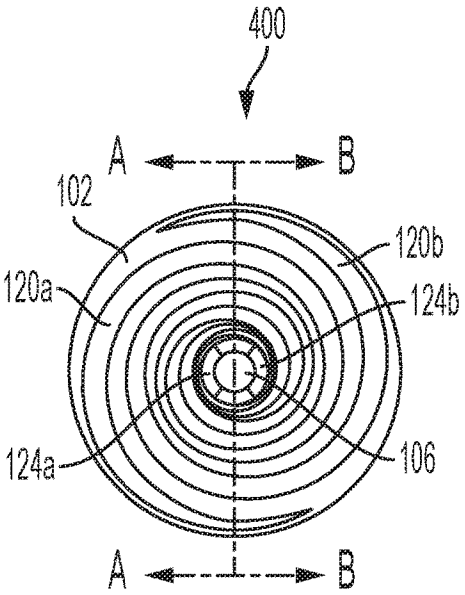
FIG. 4B illustrates an overhead view of an antenna according to one exemplary embodiment of the disclosed antennas, systems and methods.

It will be understood that openings 106 defined within an antenna substrate 102 may have other cross-sectional shapes, e.g., such as oval, triangular, square, rectangular, etc. Moreover in other embodiments, an internal opening 106 need not be centered within an antenna substrate 102. As described further herein, one or more conductive structures may be printed with conductive ink on the inner surface/s of opening/s 106, e.g., to form conductive feed network with optional balun structures for one or more conductive antenna element/s that are printed on an exterior surface/s 404 of antenna substrate 102 as shown in FIGS. 4A and 4B. Further, optional fill material 190 may be provided to fill opening/s 106 to reduce or eliminate cross talk as described further herein.

FIGS. 4A and 4B illustrate side and overhead views of a two-arm antenna 400 including an antenna substrate 102 having two spiral antenna elements 120*a* and 120*b* printed on the outer surface 402 thereof with conductive ink. FIGS. 4C and 4D illustrate opposing cross section views of the same antenna substrate 102 of two-arm antenna 400, showing separate respective antenna feed networks 108*a* and 108*b* that are printed in opposing locations on the interior side surface of internal opening 106 with conductive ink to extend from rear end 202 to front end 204 of antenna 400. A conductive coupler 124*a* on the front end 204 (e.g., nose surface) of antenna substrate 102 is present to couple feed network 108*a* to spiral antenna element 120*a*, and a conductive coupler 124*b* on the front end 204 (e.g., nose surface) of antenna substrate 102 is present to electrically couple feed network 108*b* to spiral antenna element 120*b*. Each of conductive couplers 124*a* and 124*b* may be printed with conductive ink, or may be any other electrically conductive structure suitable for electrically coupling each feed network 108*a* or 108*b* to its respective antenna element 120*a* or 120*b*. Feed network 108*a* coupled to spiral antenna element 120*a* forms a first antenna arm of antenna 400, and feed network 108*b* electrically coupled to spiral antenna element 120*b* forms a second antenna arm of antenna 400. It will be understood that FIGS. 4A and 4B are exemplary only, and that feed network/s 108 may be alternatively coupled directly to respective antenna elements 108, e.g., without the presence of separate conductive couplers 124.

As shown in FIG. 4C, feed network 108*a* is configured as a tapered conductor that is coupled between conductive coupler 124*a* and a first conductor (e.g., outer coaxial conductor) of coaxial connector 114 via a conductive coupler 125*a* shown in FIG. 3A. Conductive coupler 125*a* may be printed with conductive ink, or may be any other electrically conductive structure suitable for connecting feed network 108*a* to the first conductor of coaxial connector 114. As shown in FIG. 4D, feed network 108*b* is configured as a non-tapered conductor that is coupled between conductive coupler 124*b* and a second coaxial conductor (e.g., inner or core coaxial conductor) of coaxial connector 114 via a conductive coupler 125*b* shown in FIG. 3A. Together, tapered conductor 108*a* and non-tapered conductor 108*b* form a balun structure of a single feed network, in which the balun structure transforms the unbalanced coax geometry into a balanced geometry. It will be understood that printed tapered conductor 108*a* of FIG. 4C is exemplary only, and that other balun configurations may be printed on the inner surface of an internal opening 106 of an antenna substrate 102, e.g., such as stepped impedance (stair-stepped), etc. It is also possible that a combination balun and impedance transform structure may be printed on the inner surface of an internal opening 106 of an antenna substrate 102, e.g., in which both printed conductors 108 of a two-arm antenna are tapered by differing amounts to function both as a balun and to control impedance to match the antenna element impedance.

It will also be understood that FIG. 4C is exemplary only, and that feed network/s 108 may be alternatively coupled directly to respective coaxial connectors 114, e.g., without the presence of separate conductive couplers 125. Moreover, it is alternatively possible that feed network/s 108 may be electrically coupled to types of connectors other than coaxial connectors, e.g., such as wave guide connector/s, open wire or twin feeder (e.g., ribbon) connector/s, etc.

FIGS. 5-9 described below illustrate examples of various antenna configurations having different shapes of antenna substrates 102 combined with different configurations of antenna elements 120 according to just a few of the many possible embodiments of the antennas, systems and methods disclosed herein. It will be understood that the antenna substrate shapes and the antenna element configurations of FIG. 5-9 are exemplary only, and that other antenna substrate shapes and other antenna element configurations are possible.

Figure 5:
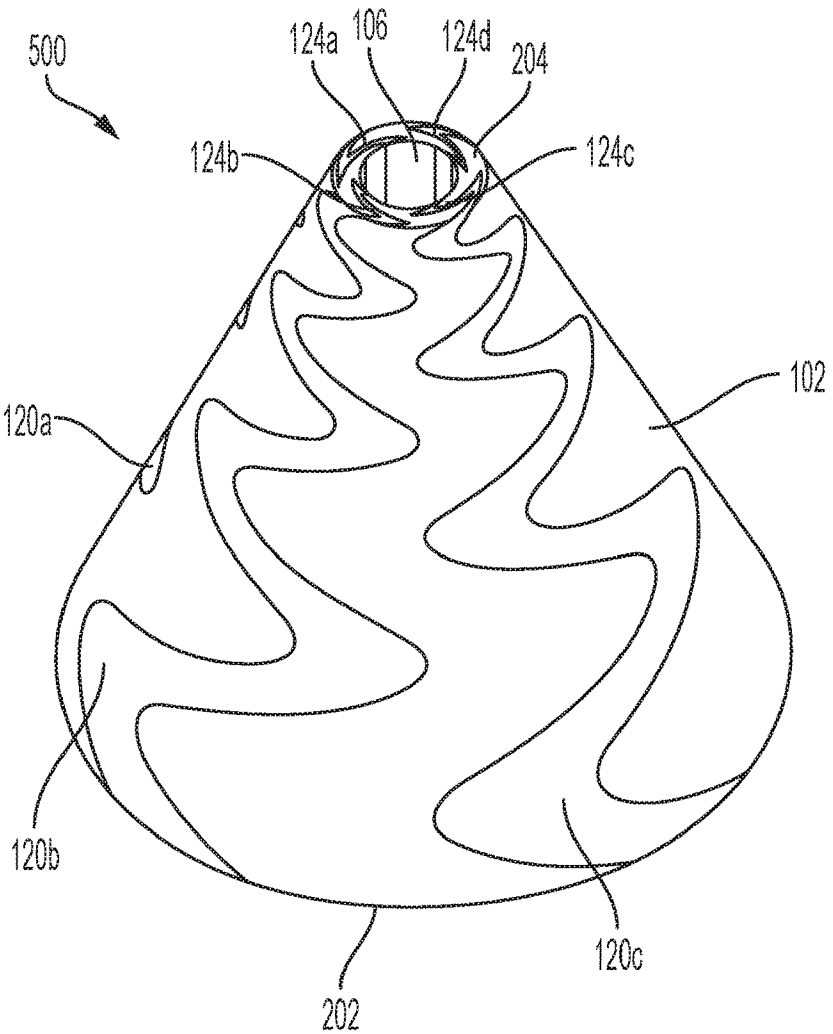
FIG. 5 illustrates a perspective view of an antenna according to one exemplary embodiment of the disclosed antennas, systems and methods.

FIG. 5 illustrates one exemplary embodiment having four separate sinuous-shaped antenna elements 120*a* to 120*d* printed on the outer surface of a conical-shaped antenna substrate 102 to form a four arm linearly polarized (dual polarized) antenna 500. Not visible are four corresponding separate conductors 108 of a single feed network printed on an interior surface of internal opening 106 and electrically coupled, respectively, to each of the four separate antenna elements 120*a* to 120*d* of FIG. 5. Each of these separate feed network conductors 108 may be so printed to extend through a center of the conical body of antenna substrate 102 of FIG. 5 from a rear end 202 to a front end 204 of the antenna substrate 102 of FIG. 5 to provide a separate interior path for an antenna feed network between antenna rear end 202 and antenna front end 204 in similar manner as described in relation to the embodiment of FIGS. 4C-4D.

Figure 6:
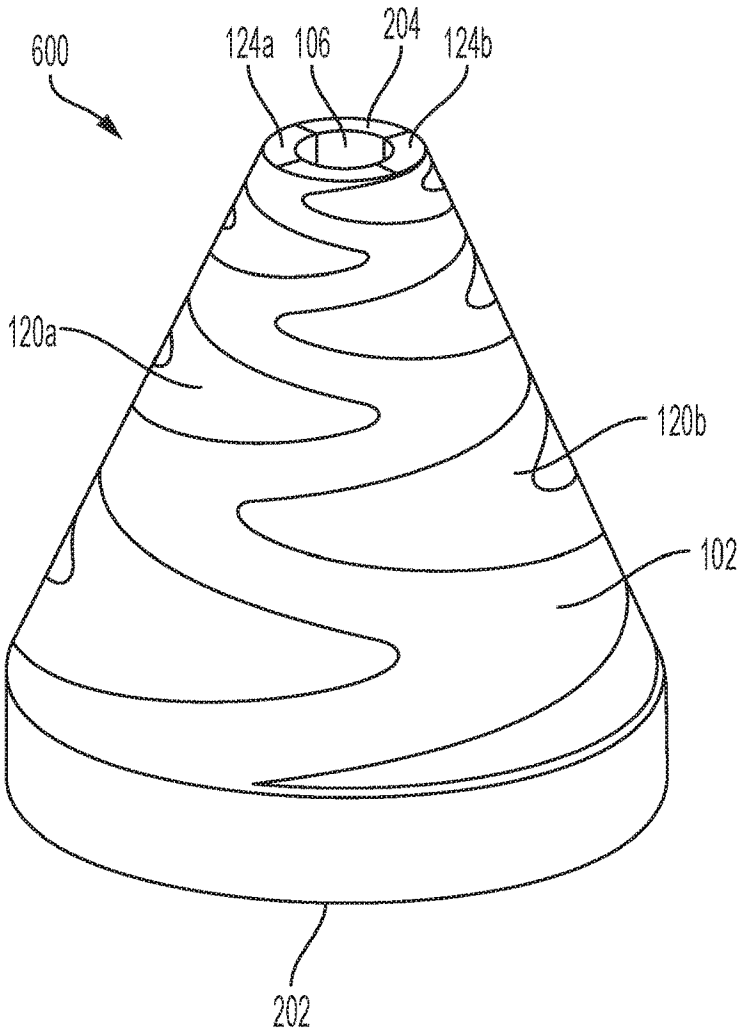
FIG. 6 illustrates a perspective view of an antenna according to one exemplary embodiment of the disclosed antennas, systems and methods.

FIG. 6 illustrates one exemplary embodiment having two separate sinuous-shaped antenna elements 120*a* and 120*b* printed on the outer surface of a semi-conical-shaped antenna substrate 102 to form a two arm linearly polarized antenna 600. As shown, the semi-conical shape includes a conical section and a cylindrical section. Not visible are two corresponding separate feed network conductors 108 printed on an interior surface of internal opening 106 and electrically coupled, respectively, to each of the two separate antenna elements 120*a* and 120*b* of FIG. 6. Each of these separate feed network conductors 108 may be so printed to extend through a center of the semi-conical body of antenna substrate 102 of FIG. 6 from a rear end 202 to a front end 204 of the antenna substrate 102 of FIG. 6 to provide a separate interior path for an antenna feed network between antenna rear end 202 and antenna front end 204 in similar manner as described in relation to the embodiment of FIGS. 4C-4D.

Figure 7:
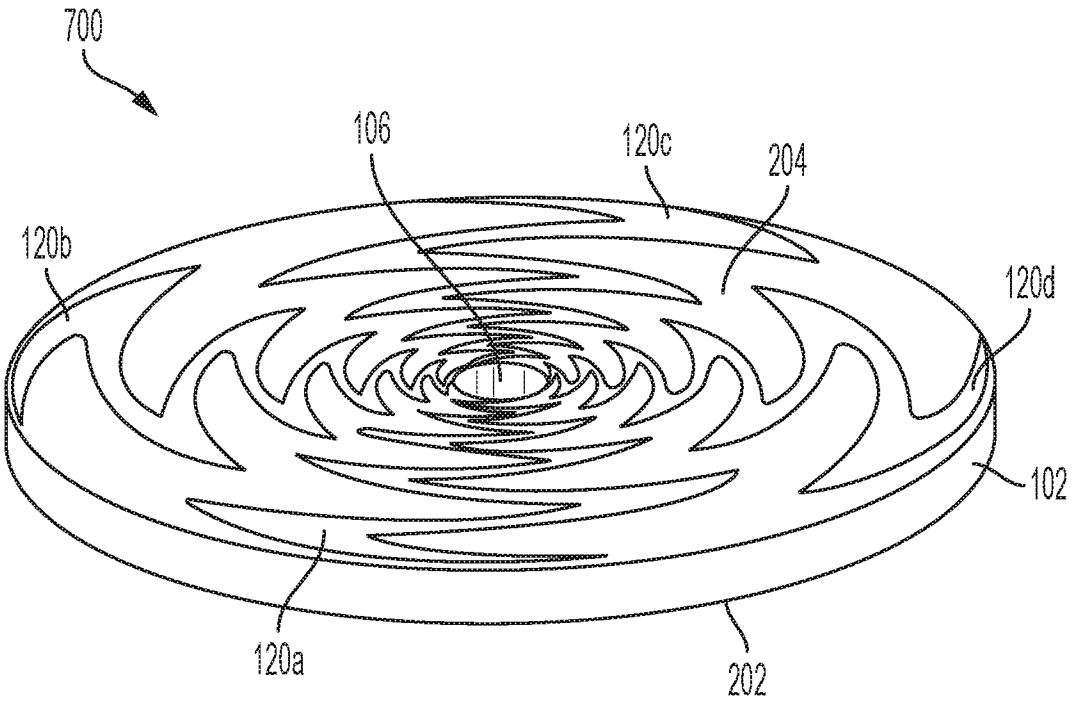
FIG. 7 illustrates a perspective view of an antenna according to one exemplary embodiment of the disclosed antennas, systems and methods.

FIG. 7 illustrates one exemplary embodiment having four separate sinuous-shaped antenna elements 120*a* to 120*d* printed on the outer surface of a flat disk-shaped antenna substrate 102 to form a four arm linearly polarized (dual polarity) antenna 700. Not visible are four corresponding separate feed network conductors 108 printed on an interior surface of internal opening 106 and electrically coupled, respectively, to each of the four separate antenna elements 120*a* to 120*d* of FIG. 7. Each of these separate feed network conductors 108 may be so printed to extend through a center of the flat body of antenna substrate 102 of FIG. 7 from a rear end 202 to a front end 204 of the antenna substrate 102 of FIG. 7 to provide a separate interior path for an antenna feed network between antenna rear end 202 and antenna front end 204 in similar manner as described in relation to the embodiment of FIGS. 4C-4D. In FIG. 7, no conductive couplers 124 are shown present. Rather, due to the shape of front end 204 of antenna substrate 102 of FIG. 7, antenna elements 120*a*-120*d* electrically couple directly to respective feed networks 108 inside opening 106.

Figure 8:
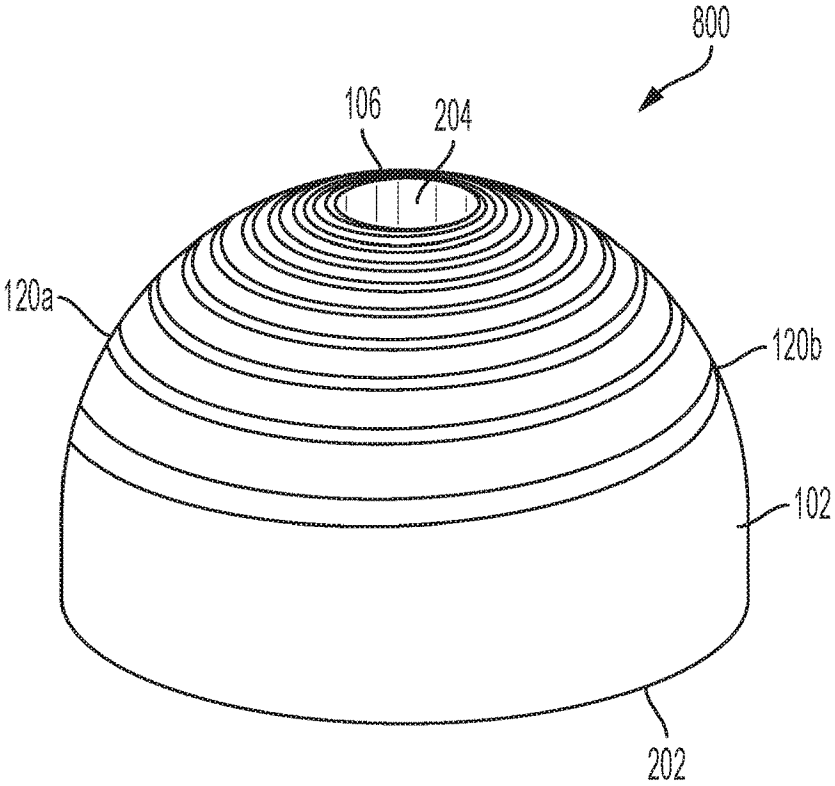
FIG. 8 illustrates a perspective view of an antenna according to one exemplary embodiment of the disclosed antennas, systems and methods.

FIG. 8 illustrates one exemplary embodiment having two separate spiral-shaped antenna elements 120*a* and 120*b* printed on the outer surface of a hemispherical-shaped antenna substrate 102 to form a dual arm circularly polarized antenna 800. Not visible are two corresponding separate feed network conductors 108 printed on an interior surface of internal opening 106 and electrically coupled, respectively, to each of the four separate antenna elements 120*a* and 120*b* of FIG. 8. Each of these separate feed network conductors 108 may be so printed to extend through a center of the hemispherical body of antenna substrate 102 of FIG. 8 from a rear end 202 to a front end 204 of the antenna substrate 102 of FIG. 8 to provide a separate interior path for an antenna feed network between antenna rear end 202 and antenna front end 204 in similar manner as described in relation to the embodiment of FIGS. 4C-4D. In FIG. 8, no conductive coupler 124 is present. Rather, due to the shape of front end 204 of antenna substrate 102, antenna elements 120*a* and 120*b* electrically couple directly to respective feed networks 108 inside opening 106.

Figure 9:
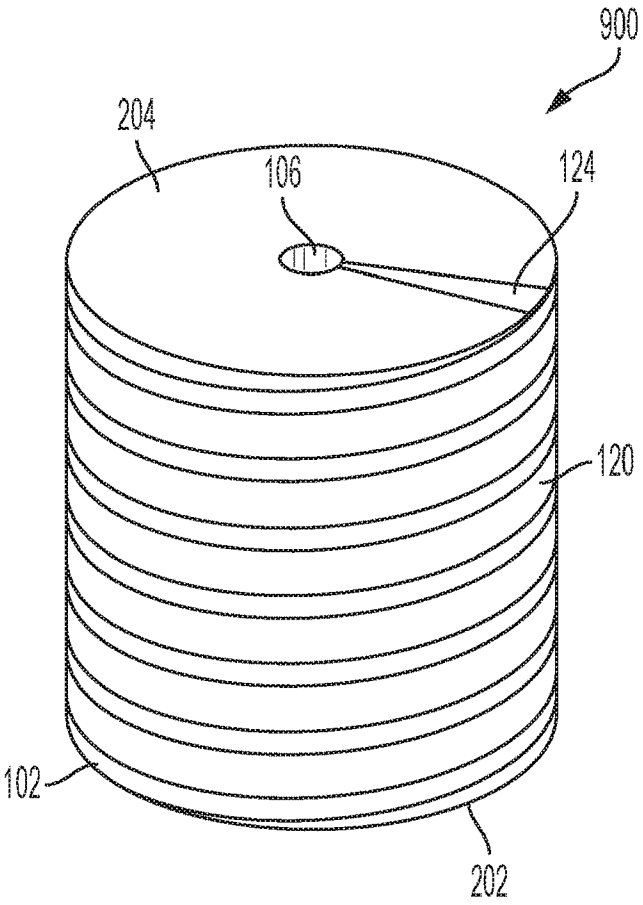
FIG. 9 illustrates a perspective view of an antenna according to one exemplary embodiment of the disclosed antennas, systems and methods.

FIG. 9 illustrates one exemplary embodiment having a single helical-shaped antenna element 120 printed on the outer surface of a cylindrical-shaped antenna substrate 102 to form a single arm circularly polarized antenna 900. Not visible is a corresponding feed network conductor 108 (optionally configured with a balun structure) printed on an interior surface of internal opening 106 and electrically coupled to the antenna element 120 of FIG. 9. This feed network conductor 108 may be so printed to extend through a center of the cylindrical body of antenna substrate 102 of FIG. 9 from a rear end 202 to a front end 204 of the antenna substrate 102 of FIG. 9 to provide an interior path for an antenna feed network between antenna rear end 202 and antenna front end 204 in similar manner as described in relation to the embodiment of FIGS. 4C-4D.

It will be understood that the antenna embodiments of FIGS. 5-9 are exemplary only, and that other types and/or shapes of antenna configurations may be implemented. In this regard, the disclosed antennas, systems and methods may be used to feed a variety of types of planar and/or volumetric antennas. Examples of antenna characteristics which may be implemented in a variety of combinations include, but are not limited to, varying antenna form factors (e.g., flat, cylindrical, conical, hemispherical, etc.), varying antenna pattern (e.g., dipole, helical, spiral (equiangular/logarithmic or Archimedean), sinuous, etc.), varying number of antenna arms (e.g., 1, 2, 4, 8, . . . N, etc.), varying antenna polarization (e.g., linear, circular, elliptical, single-pol, dual-pol, etc.).

Figure 10:
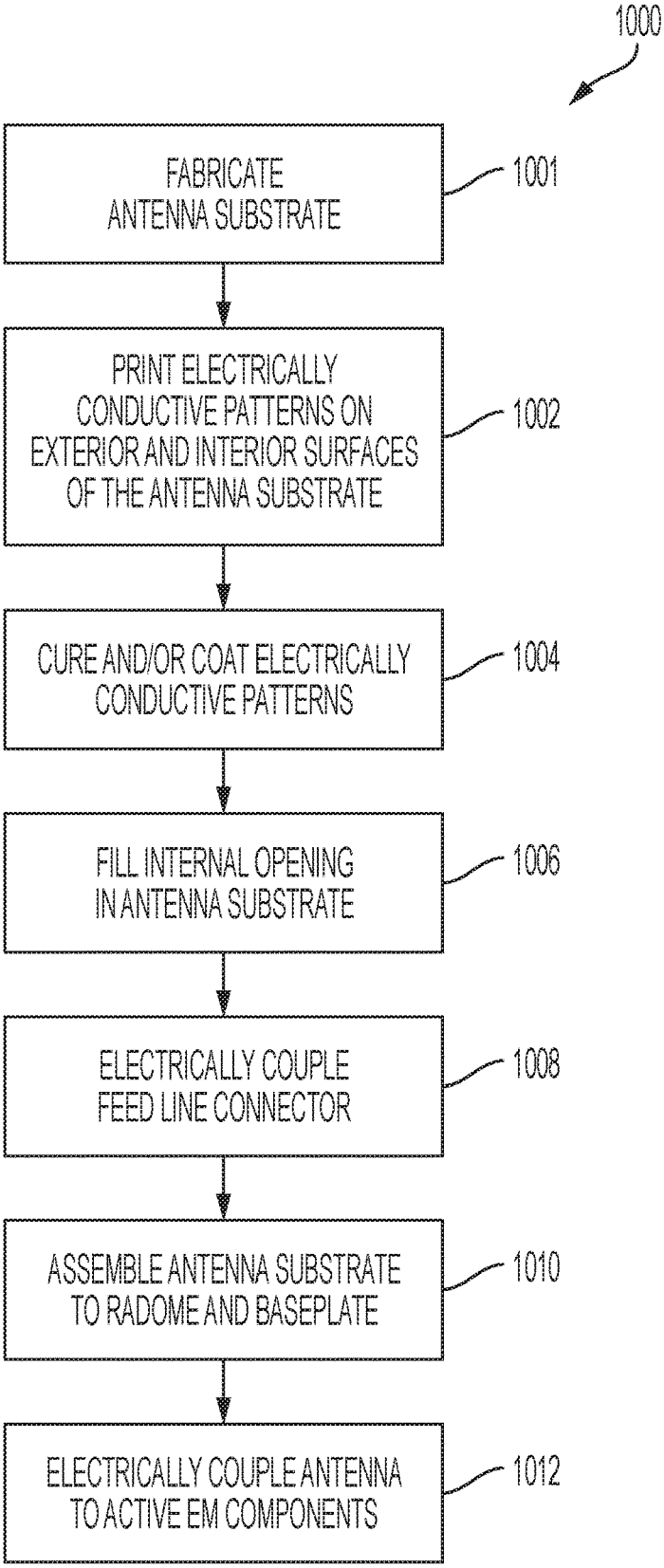
FIG. 10 is a flow chart illustrating a method according to one exemplary embodiment of the disclosed antennas, systems and methods.

In one embodiment, components (e.g., feed network/s with optional configuration, antenna element/s, etc.) of the disclosed antennas may be printed on one or more surfaces (e.g., sides, faces, etc.) of an antenna substrate using an applicator. For example, electrically conductive ink may be applied by a fixed applicator or syringe that is held in stationary position while the antenna substrate 102 is moved relative to the fixed applicator or syringe (e.g., by computer controlled robotics) in various directions so that the electrically conductive ink is printed on the surface/s of the antenna substrate 102 in a pattern's that forms the conductive components of an antenna. These conductive components include, for example, one or more antenna element/s 120, one or more feed network/s 108 with optional balun configuration, conductive coupler/s 124 and 125, etc. FIG. 10 illustrates one exemplary embodiment of a method 1000 for fabricating an antenna such as illustrated and described in relation to the previous figures herein.

As shown in step 1001 of FIG. 10, an antenna substrate 102 is first fabricated (e.g., cast, molded or otherwise shaped) from one or more suitable materials such as described elsewhere herein. One or more openings 106 may be defined in the body of a substrate 102 at the same time as the rest of substrate 102 (e.g., as part of the same molding or casting process), or may be separately formed (e.g., drilled through a solid antenna substrate 102 that has been previously formed). The resulting antenna substrate 102 may thus be provided with one or more outer surfaces, and one or more inner surfaces.

Next, in step 1002, electrically-conductive patterns (e.g., conductive traces) are printed on the exterior surface/s of antenna substrate 102 and interior surface/s of opening/s 106. In one embodiment, a applicator (e.g., syringe or proboscis) or other type of flow-based micro-dispensing device may be employed to dispense an electrically conductive ink (e.g., such as electrically conductive silver ink, electrically conductive gold ink, etc.) through an opening (e.g., applicator tip) that is sized to provide a controlled flow of the electrically conductive ink onto the surface/s of the antenna substrate 102 to create features of antenna element/s 120, feed network 108 with optional balun configuration, and optionally conductive couplers 124 and 125. In one embodiment, the electrically conductive ink may be applied to form a conductive pattern having a thickness of from 0.0005" to 0.003", it being understood that conductive patterns may be formed with greater or lesser thicknesses as may be suitable for a given application.

The conductive metal ink of step 1002 may include a metal powder (e.g., gold or silver) mixed with a polymer binder. However, other types of conductive inks (both meal and non-metal conductive inks) may be employed that include other types of binders, other types of metal and/or non-metal conductive particles or other conductive constituents.

In one embodiment, the applicator may be held stationary while the antenna substrate 102 is moved relative to the applicator to create the desired printed electrically conductive patterns for antenna elements 120, feed networks 108 and optionally conductive couplers 124 and 125 on the exterior and interior surfaces of the antenna substrate 102.

In one embodiment of step 1002, the electrically conductive patterns may be printed on both the exterior surfaces and interior surfaces (within internal opening/s 106) of antennal substrate 102 optionally using a single printing operation. For example, the same printing equipment may be employed to print each of network feed/s 108, antenna element/s 120 and optionally conductive couplers 124 and 125 while the antenna substrate 102 is moved relative to the applicator without interruption of the printing process. In one exemplary embodiment, this allows an antenna substrate 102 to be mounted or otherwise loaded into a process environment, and the network feed/s 108, antenna element/s 120 and optionally conductive couplers 124 and 125 then printed on surfaces of the substrate 102 without removing the substrate 102 from the process environment, and in a further embodiment without changing the applicator used to apply the conductive ink.

Next, in step 1004, the printed conductive patterns printed on substrate 102 are allowed to cure (if required) to form a completed antenna pattern on antenna substrate 102 (e.g., by air curing, ultraviolet light curing, and/or temperature curing depending on chemistry of the conductive patterns). Optionally, the electrically conductive printed patterns may be coated with an electrically conductive material (e.g., such as immersion gold over electroless nickel) in step 1004.

Step 1004 may be followed in step 1006 by filling the internal opening 106 with epoxy 190 (e.g., such as polyurethane, acrylic, cyanoacrylate, etc.) or other fill material (such as dielectric foam) having a dielectric permittivity value ($\varepsilon_1$) that is greater than a dielectric permittivity value ($\varepsilon_2$) of the material of the antenna substrate 102 in order to reduce or eliminate coupling and crosstalk between feed network/s 108 and the externally printed antenna element/s 120. Opening/s 106 may be filled with fill material 190 (e.g., by injection or other application method), and then allowed to cure. In one embodiment, values of each of $\varepsilon_1$ and $\varepsilon_2$ may be selected from dielectric permittivity values ranging from 1 to 20, and such that the selected $\varepsilon_1$ is greater than the selected $\varepsilon_2$. Example dielectric permittivity values for fill material 190 and antenna substrate 102 include, for example, a $\varepsilon_1$ of fill material 190 of 5.0 combined with a $\varepsilon_2$ of antenna substrate 102 of 3.2, it being understood that combinations of other relatively greater values of $\varepsilon_1$ of fill material 190 relative to other relatively lesser values of $\varepsilon_2$ of antenna substrate 102 may be employed in other embodiments (including dielectric permittivity values greater than 20 and/or less than 1).

In step 1008, a feed line connector (e.g., coaxial connector 114) may be electrically coupled (e.g., soldered) to conductive coupler/s 125.

In step 1010, antenna substrate 102 of step 1008 may be assembled with other optional components including, for example, a radome 104 and baseplate 110.

The assembly of step 1010 is then ready to be electrically coupled in step 1012 to active EM signal reception and/or transmission electronics (e.g., such as RF receiver, RF transmitter or RF transceiver), e.g., via coaxial cable feed line/s 112, coaxial connector/s 114 and 116, etc.

Figure 11:
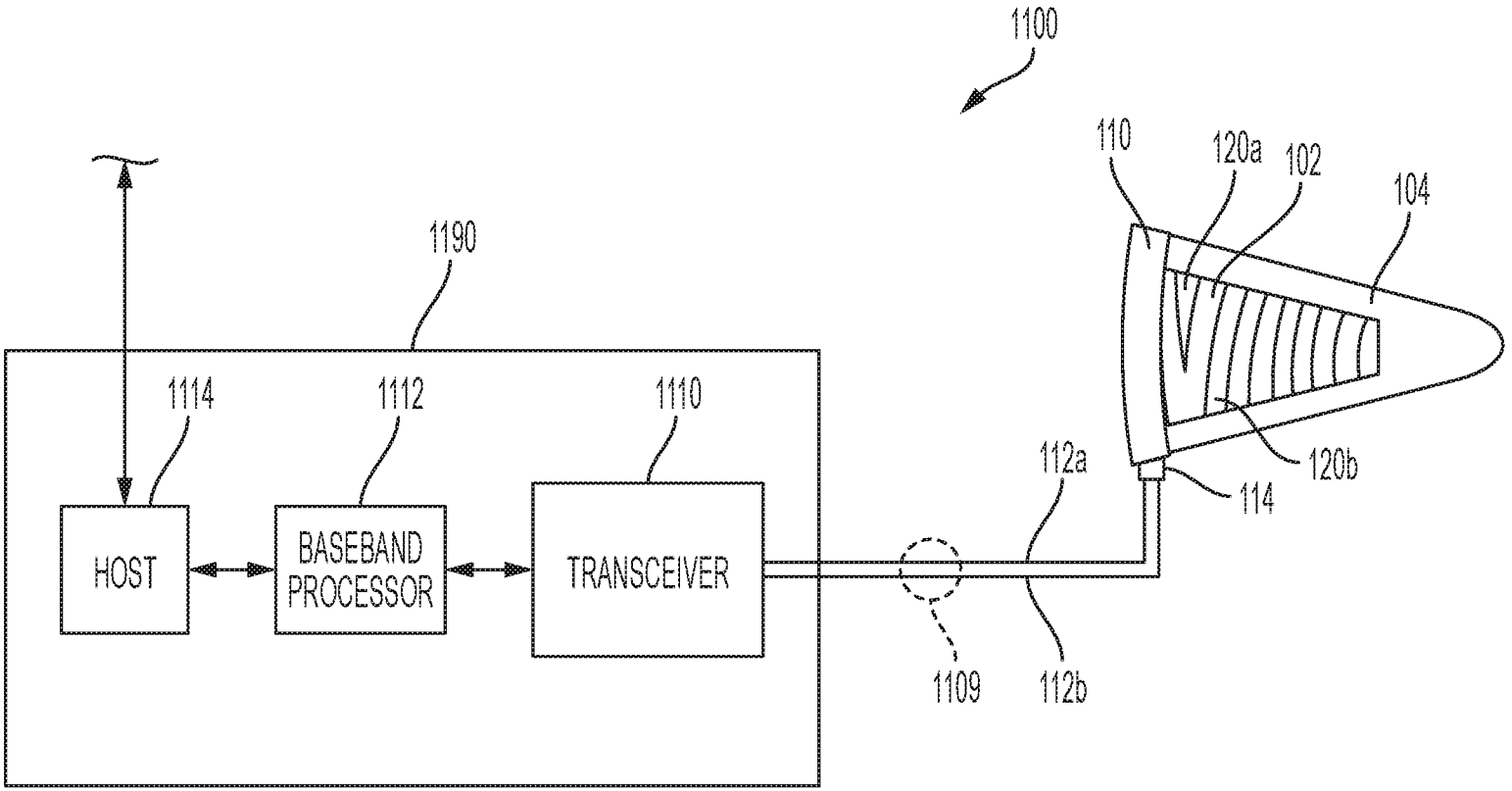
FIG. 11 is a block diagram illustrating a system according to one exemplary embodiment of the disclosed antennas, systems and methods.

FIG. 11 illustrates a block diagram of one exemplary embodiment of a system 1100 including an antenna and radome assembly from step 1010 coupled to active electromagnetic (EM) signal components in the form of a RF transceiver, for example, on a mobile platform (e.g., such as an fixed wing or rotary aircraft, train, truck, automobile, spacecraft, rocket, etc.) or on a stationary or ground-based installation (e.g., such as a cellular tower, airport control tower, etc.). However, it will be understood that other applications are possible. For example, in other embodiments, the disclosed antennas, systems and methods may be employed for other types of cellular communication applications, e.g., such as antennas for mobile phones, tablet devices, notebook computers, etc. Additionally, besides RF circuitry, it will be understood that in other embodiments an antenna and radome assembly 1100 may be similarly electrically coupled to other types of EM signal receiving and/or transmitting circuitry. Further, besides an EM signal transceiver, active EM signal components may alternatively be configured as an EM signal receiver or an EM signal transmitter.

Still referring to FIG. 11, antenna and radome assembly 1100 is shown coupled in RF signal communication with active RF transceiver components 1190 (e.g., with antenna elements 102*a* and 102*b* electrically coupled via respective conductive couplers 124*a* and 124*b* to the active RF transceiver components through respective feed networks 108*a* and 108*b* as previously described herein). Returning to FIG. 11, feed networks 108*a* and 108*b* are electrically coupled in turn via connector 114 to a feed line 1109 (e.g., in the form of coaxial core conductor 112*a* and coaxial outer conductor 112*b*, respectively). Coaxial conductors 112 of feed line 1109 are in turn electrically coupled to RF transceiver circuitry 1110, for purposes of communicating received RF signals from antenna elements 120 of assembly 1100 to transceiver 1110, and for communicating transmitted RF signals from transceiver 1110 to antenna elements 120 of assembly 1100, and for communicating received RF signals from antenna elements 120 to transceiver 1110. It will be understood that in other embodiments, different types of feed lines may be employed, e.g., such as wave guide conductors, open wire or twin feeder (e.g., ribbon) conductors, etc.

Transceiver 1110 may include circuitry, for example, frequency upconverter/s and downconverter/s, amplifier/s, filter/s, and analog to digital converter/s (ADC) and digital to analog converter/s (DAC) such as known in the art. Baseband processor 1112 may be coupled to transfer RF signal digital data between transceiver 1110 and one or more additional processors 1114. Examples of such processor/s include, but are not limited to, host processor/s that execute an operating system and one or more applications for generating data for outgoing RF signals to be transmitted from antenna elements 120, and/or for processing data received from incoming RF signals received by antenna elements 120.

It will be understood that one or more of the tasks, functions, or methodologies described herein (e.g., including those described herein for components 1110, 1112, 1114, etc.) may be implemented by circuitry and/or by a computer program of instructions (e.g., computer readable code such as firmware code or software code) embodied in a non-transitory tangible computer readable medium (e.g., optical disk, magnetic disk, non-volatile memory device, etc.), in which the computer program comprising instructions is configured when executed on a processing device in the form of a programmable integrated circuit (e.g., processor such as CPU, microcontroller, microcontroller, microprocessor, ASIC, etc. or programmable logic device "PLD" such as FPGA, complex programmable logic device "CPLD", etc.) to perform one or more steps of the methodologies disclosed herein. In one embodiment, a group of such processing devices may be selected from the group consisting of CPU, microcontroller, microcontroller, microprocessor, FPGA, CPLD and ASIC. The computer program of instructions may include an ordered listing of executable instructions for implementing logical functions in a computer system or component thereof. The executable instructions may include a plurality of code segments operable to instruct components system components to perform the methodologies disclosed herein.

It will also be understood that one or more steps of the present methodologies may be employed in one or more code segments of the computer program. For example, a code segment executed by a processing device may include one or more steps of the disclosed methodologies. It will be understood that a processing device may be configured to execute or otherwise be programmed with software, firmware, logic, and/or other program instructions stored in one or more non-transitory tangible computer-readable mediums (e.g., data storage devices, flash memories, random update memories, read only memories, programmable memory devices, reprogrammable storage devices, hard drives, floppy disks, DVDs, CD-ROMs, and/or any other tangible data storage mediums) to perform the operations, tasks, functions, or actions described herein for the disclosed embodiments.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed antennas, systems and methods may be utilized in various combinations and/or independently. Thus, the invention is not limited to only those combinations shown herein, but rather may include other combinations.

What is claimed is:

1. An antenna, comprising:

an antenna substrate comprising a body having opposing first and second ends with at least one internal opening defined to extend through the body of the antenna substrate from the first end to the second end of the antenna substrate body, where an interior surface of the antenna substrate body surrounds and defines the internal opening, and where the body of the antenna substrate extends from the interior surface of the antenna substrate body to an exterior surface of the antenna substrate body;

at least one feed network printed as an electrically conductive pattern on the interior surface of the antenna substrate body, the feed network extending from the first end to the second end of the antenna substrate body; and at least one antenna element printed as an electrically conductive pattern on the exterior surface of the antenna substrate body, the antenna element being electrically coupled to the feed network;

where the antenna substrate body is a single piece of a first material; and where the antenna further comprises a second material filling the internal opening from the first end to the second end of the antenna substrate, the second material having a dielectric permittivity value ($\varepsilon_1$) that is greater than a dielectric permittivity value ($\varepsilon_2$) of the first material.

2. The antenna of claim 1, where the at least one feed network comprises a balanced to unbalanced conductor (balun) structure.

3. The antenna of claim 1, where the exterior surface of the antenna substrate body has at least one of a flat shape, cylindrical shape, conical shape or hemispherical shape; where the at least one antenna element comprises an antenna pattern having a shape that is at least one of dipole, helical, spiral or sinuous; and where the electrically conducive pattern of the at least one antenna element on the exterior of the surface of the antenna substrate body forms one of a linearly polarized antenna, circular polarized antenna, or elliptical polarized antenna.

4. The antenna of claim 1, where the electrically conductive pattern of the at least one feed network is electrically conductive ink printed on the interior surface of the antenna substrate body.

5. The antenna of claim 1, where the exterior surface of the antenna substrate body has a conical shape extending from the first end to the second end of the antenna substrate body, the first end of the antenna substrate body having a smaller diameter than the second end of the antenna substrate body; where the interior surface of the antenna substrate body is a cylindrical surface that extends from the first end to the second end of the antenna substrate body to surround and define the internal opening as a cylindrical shape that extends from the first end to the second end of the antenna substrate body; and where the at least one feed network is printed on the cylindrical interior surface of the antenna substrate body to face inward into the internal opening from the surrounding cylindrical interior surface of the antenna substrate body.

6. The antenna of claim 1, where the antenna does not include a board or circuit card for the feed network.

7. An antenna, comprising:

an antenna substrate comprising a body having opposing first and second ends with at least one internal opening defined to extend through the body of the antenna substrate from the first end to the second end of the antenna substrate body, where an interior surface of the antenna substrate body surrounds and defines the internal opening, and where the body of the antenna substrate extends from the interior surface of the antenna substrate body to an exterior surface of the antenna substrate body;

at least one feed network printed as an electrically conductive pattern on the interior surface of the antenna substrate body, the feed network extending from the first end to the second end of the antenna substrate body; and at least one antenna element printed as an electrically conductive pattern on the exterior surface of the antenna substrate body, the antenna element being electrically coupled to the feed network;

where the at least one feed network comprises multiple separate feed networks printed as separate electrically conductive patterns on the interior surface of the antenna substrate body, each of the multiple separate feed networks extending from the first end to the second end of the antenna substrate body;

where the at least one antenna element comprises multiple separate antenna elements printed as separate electrically conductive patterns on the exterior surface of the antenna substrate body; and where each of the multiple separate antenna elements is electrically coupled to a different one of the multiple separate feed networks by a separate printed electrically conductive pattern.

8. An antenna, comprising:

an antenna substrate comprising a body having opposing first and second ends with at least one internal opening defined to extend through the body of the antenna substrate from the first end to the second end of the antenna substrate body, where an interior surface of the antenna substrate body surrounds and defines the internal opening, and where the body of the antenna substrate extends from the interior surface of the antenna substrate body to an exterior surface of the antenna substrate body;

at least one feed network printed as an electrically conductive pattern on the interior surface of the antenna substrate body, the feed network extending from the first end to the second end of the antenna substrate body; and at least one antenna element printed as an electrically conductive pattern on the exterior surface of the antenna substrate body, the antenna element being electrically coupled to the feed network;

where the exterior surface of the antenna substrate body has a conical shape extending from the first end to the second end of the antenna substrate body, the first end of the antenna substrate body having a smaller diameter than the second end of the antenna substrate body; where the interior surface of the antenna substrate body is a cylindrical surface that extends from the first end to the second end of the antenna substrate body to surround and define the internal opening as a cylindrical shape that extends from the first end to the second end of the antenna substrate body; and where the at least one feed network is printed on the cylindrical interior surface of the antenna substrate body to face inward into the internal opening from the surrounding cylindrical interior surface of the antenna substrate body;

where the at least one feed network comprises multiple separate feed networks printed as separate electrically conductive patterns on the interior surface of the antenna substrate body, each of the multiple separate feed networks extending from the first end to the second end of the antenna substrate body, and at least one of the separate feed networks comprising a tapered balanced to unbalanced conductor (balun) structure;

where the at least one antenna element comprises multiple separate antenna elements printed as separate electrically conductive patterns on the exterior surface of the antenna substrate body, each of the multiple separate antenna elements being electrically coupled to a different one of the multiple separate feed networks; and where the at least one antenna element comprises an antenna pattern having a shape that is at least one of dipole, helical, spiral or sinuous.

9. A method, comprising:

printing at least one feed network as an electrically conductive pattern on an interior surface of an antenna substrate body, the interior surface of the antenna substrate body surrounding and defining at least one internal opening to extend through the antenna substrate body from a first end of the antenna substrate body to an opposing second end of the antenna substrate body, the feed network extending from the first end to the second end of the antenna substrate body;

printing at least one antenna element as an electrically conductive pattern on an exterior surface of the antenna substrate body; and electrically coupling the antenna element to the feed network;

where the antenna substrate body is a single piece of a first material; and where the method further comprises providing a second material filling the internal opening from the first end to the second end of the antenna substrate, the second material having a dielectric permittivity value ($\varepsilon_1$) that is greater than a dielectric permittivity value ($\varepsilon_2$) of the first material.

10. The method of claim 9, where the at least one feed network comprises a balanced to unbalanced conductor (balun) structure.

11. The method of claim 9, where the exterior surface of the antenna substrate body has at least one of a flat shape, cylindrical shape, conical shape or hemispherical shape; and where the at least one antenna element comprises an antenna pattern having a shape that is at least one of dipole, helical, spiral or sinuous; and where the method further comprises printing the electrically conductive pattern of the at least one antenna element on the exterior of the surface of the antenna substrate body to form one of a linearly polarized antenna, circular polarized antenna, or elliptical polarized antenna.

12. The method of claim 9, further comprising printing the electrically conducive pattern of the at least one feed network on the interior surface of the antenna substrate body with electrically conductive ink.

13. The method of claim 9, where the exterior surface of the antenna substrate body has a conical shape extending from the first end to the second end of the antenna substrate body, the first end of the antenna substrate body having a smaller diameter than the second end of the antenna substrate body; where the interior surface of the antenna substrate body is a cylindrical surface that extends from the first end to the second end of the antenna substrate body to surround and define the internal opening as a cylindrical shape that extends from the first end to the second end of the antenna substrate body; and where the method further comprises printing the at least one feed network on the cylindrical interior surface of the antenna substrate body to face inward into the internal opening from the surrounding cylindrical interior surface of the antenna substrate body.

14. The method of claim 9, where the antenna does not include a board or circuit card for the feed network.

15. The method of claim 9, where the method further comprises providing the second material filling the internal opening from the first end to the second end of the antenna substrate with the electrically conductive pattern being disposed between the second material and the antenna substrate body.

16. The method of claim 9, further comprising printing the feed network and the antenna element together using a single printing operation without interruption of the printing process.

17. A method, comprising:

printing at least one feed network as an electrically conductive pattern on an interior surface of an antenna substrate body, the interior surface of the antenna substrate body surrounding and defining at least one internal opening to extend through the antenna substrate body from a first end of the antenna substrate body to an opposing second end of the antenna substrate body, the feed network extending from the first end to the second end of the antenna substrate body;

printing at least one antenna element as an electrically conductive pattern on an exterior surface of the antenna substrate body; and electrically coupling the antenna element to the feed network;

where the method further comprises printing multiple separate feed networks as separate electrically conductive patterns on the interior surface of the antenna substrate body, each of the multiple separate feed networks extending from the first end to the second end of the antenna substrate body, printing multiple separate antenna elements as separate electrically conductive patterns on the exterior surface of the antenna substrate body, and printing multiple separate electrically conductive patterns that each electrically couples one of the multiple separate antenna elements to a different one of the multiple separate feed networks.

18. A method, comprising:

printing at least one feed network as an electrically conductive pattern on an interior surface of an antenna substrate body, the interior surface of the antenna substrate body surrounding and defining at least one internal opening to extend through the antenna substrate body from a first end of the antenna substrate body to an opposing second end of the antenna substrate body, the feed network extending from the first end to the second end of the antenna substrate body;

printing at least one antenna element as an electrically conductive pattern on an exterior surface of the antenna substrate body; and electrically coupling the antenna element to the feed network;

where the exterior surface of the antenna substrate body has a conical shape extending from the first end to the second end of the antenna substrate body, the first end of the antenna substrate body having a smaller diameter than the second end of the antenna substrate body;

where the interior surface of the antenna substrate body is a cylindrical surface that extends from the first end to the second end of the antenna substrate body to surround and define the internal opening as a cylindrical shape that extends from the first end to the second end of the antenna substrate body;

where the method further comprises:

printing the at least one feed network on the cylindrical interior surface of the antenna substrate body to face inward into the internal opening from the surrounding cylindrical interior surface of the antenna substrate body, printing multiple separate feed networks as separate electrically conductive patterns on the interior surface of the antenna substrate body, each of the multiple separate feed networks extending from the first end to the second end of the antenna substrate body, and at least one of the separate feed networks comprising a tapered balanced to unbalanced conductor (balun) structure, printing multiple separate antenna elements as separate electrically conductive patterns on the exterior surface of the antenna substrate body, and electrically coupling each of the multiple separate antenna elements to a different one of the multiple separate feed networks; and where the at least one antenna element comprises an antenna pattern having a shape that is at least one of dipole, helical, spiral or sinuous.

19. A system, comprising an assembly that includes:

an antenna; and a radome mechanically coupled to the antenna in a position that at least partially surrounds the antenna;

where the antenna comprises:

an antenna substrate body having opposing first and second ends with at least one internal opening defined to extend through the antenna substrate body from the first end to the second end of the antenna substrate body, where an interior surface of the antenna substrate body surrounds and defines the internal opening, and where the body of the antenna substrate extends from the interior surface of the antenna substrate body to an exterior surface of the antenna substrate body, at least one feed network printed as an electrically conductive pattern on the interior surface of the antenna substrate body, the feed network extending from the first end to the second end of the antenna substrate body; and at least one antenna element printed as an electrically conductive pattern on the exterior surface of the antenna substrate body, the antenna element being electrically coupled to the feed network;

where the antenna substrate body is a single piece of a first material; and where the antenna further comprises a second material filling the internal opening from the first end to the second end of the antenna substrate, the second material having a dielectric permittivity value ($\varepsilon_1$) that is greater than a dielectric permittivity value ($\varepsilon_2$) of the first material.

20. The system of claim 19, where the exterior surface of the antenna substrate body has at least one of a flat shape, cylindrical shape, conical shape or hemispherical shape; where the at least one antenna element comprises an antenna pattern having a shape that is at least one of dipole, helical, spiral or sinuous; and where the radome comprises an inner surface that is complementary in size and shape to a size and shape of the exterior surface of the antenna substrate body with the radome mechanically assembled around the antenna substrate body.

21. The system of claim 19, where the electrically conducive pattern of the at least one antenna element on the exterior of the surface of the antenna substrate body forms one of a linearly polarized antenna, circular polarized antenna, or elliptical polarized antenna.

22. The system of claim 19, where the exterior surface of the antenna substrate body has a conical shape extending from the first end to the second end of the antenna substrate body, the first end of the antenna substrate body having a smaller diameter than the second end of the antenna substrate body; where the interior surface of the antenna substrate body is a cylindrical surface that extends from the first end to the second end of the antenna substrate body to surround and define the internal opening as a cylindrical shape that extends from the first end to the second end of the antenna substrate body; and where the at least one feed network is printed on the cylindrical interior surface of the antenna substrate body to face inward into the internal opening from the surrounding cylindrical interior surface of the antenna substrate body.

23. The system of claim 19, further comprising one or more active electromagnetic (EM) signal components electrically coupled to the at least one antenna element through the feed network.

24. The system of claim 23, where the one or more active EM signal components comprise a radio frequency (RF) receiver, RF transmitter or a RF transceiver.

25. The system of claim 23, further comprising at least one conductor of a coaxial cable feed line electrically coupled between the one or more active EM signal components and the feed network.

26. A method of operating the system of claim 23, comprising providing EM signals from the active EM signal components through the feed network for transmission by the at least one antenna element, providing EM signals received by the at least one antenna element to the active EM signal components through the feed network, or a combination thereof.

* * * * *